US007018489B2

(12) United States Patent
Bennon et al.

(10) Patent No.: US 7,018,489 B2
(45) Date of Patent: Mar. 28, 2006

(54) ARTIFICIAL AGING CONTROL OF ALUMINUM ALLOYS

(75) Inventors: William D. Bennon, Kittanning, PA (US); Vivek M. Sample, Murrysville, PA (US); Dhruba J. Chakrabarti, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 236 days.

(21) Appl. No.: 10/294,093

(22) Filed: Nov. 13, 2002

(65) Prior Publication Data

US 2004/0089381 A1 May 13, 2004

(51) Int. Cl.
*C22F 1/04* (2006.01)

(52) U.S. Cl. ..... 148/698; 148/701

(58) Field of Classification Search ..... 148/690, 148/693, 694, 698, 697, 701
See application file for complete search history.

(56) References Cited

U.S. PATENT DOCUMENTS 3,454,435 A * 7/1969 Jacobs ..... 148/690
3,645,804 A 2/1972 Ponchel ..... 148/128
5,785,777 A 7/1998 Cantrell et al. ..... 148/694
5,865,911 A 2/1999 Miyasato et al. ..... 148/439
6,048,415 A 4/2000 Nakai et al. ..... 148/417

OTHER PUBLICATIONS

"ASM Handbook: vol. 4 Heat Treating", ASM International, 1991, pp. 861-865.*
Reed-Hill, Robert. "Physical Metallurgy Principles", 3rd ed. PWS Publishing Co., pp 159-160,532-534.*

* cited by examiner

*Primary Examiner*—George Wyszumierski
*Assistant Examiner*—Janelle Morillo
(74) *Attorney, Agent, or Firm*—H. Eric Fischer; Eckert Seamans Cherin & Mellott, LLC

(57) ABSTRACT

A method of artificially aging an aluminum alloy product to achieve a property in the product having the steps of aging the product to achieve the property by heating the product over an aging period, the aging period including a time period where the product is in an underaged state, and terminating the heating when the property is achieved according to a mathematical formula. The property is calculated as a function of time and product temperature measured over the aging period. Calculation of the property includes integration of the thermal effects on the product over the entire aging period including during the time period of underaged product state.

3 Claims, 7 Drawing Sheets

Aging models

Isothermal Aging (175 F to 250 F)

Isothermal Aging (275 F to 330 F)

Temperature Readings

Calculated Tensile Yield Strength

Calculated Rate of Strength Change

ARTIFICIAL AGING CONTROL OF ALUMINUM ALLOYS

BACKGROUND OF THE INVENTION

1. Field of the Invention

The present invention pertains to artificial aging of aluminum alloy products, particularly to methods of artificially aging aluminum alloy products which include integration of the time and temperature effects on aluminum alloy products over an entire aging process.

2. Prior Art

Production of aluminum alloys includes casting of ingots which may be deformed into wrought products such as rolled plates, forgings or extrusions. The wrought product is solution heat treated by heating to one or more temperatures such as about 800 to 1100° F. to take substantial portions, preferably all or substantially all, of the soluble alloying elements (such as for an Aluminum Association (AA) alloy of the 7xxx series, zinc, magnesium and copper) into solution. After heating to the elevated temperature, the product is rapidly cooled or quenched to complete the solution heat treating procedure. Such cooling may be accomplished by immersion in a suitably sized tank of water or other liquid or by water sprays, although air chilling is usable as supplementary or substitute cooling means for some cooling. After quenching, certain products may be cold worked, such as by stretching or compression where feasible, to relieve internal stresses or straighten the product, even possibly in some products such as those of the AA 2xxx series, to further strengthen the wrought product. For instance, the product may be stretched 1 to 1½% or more, or otherwise cold worked a generally equivalent amount. A solution heat treated (and quenched) product, with or without cold working, is then considered to be in a precipitation-hardenable condition, or ready for artificial aging according to preferred artificial aging methods as herein described or other artificial aging techniques. As used herein, the term "solution heat treat", unless indicated otherwise, shall be meant to include quenching.

After rapidly quenching, and cold working if desired, the wrought product is artificially aged by heating to an appropriate temperature to improve strength and other properties either alone or in conjunction with other processes such as mechanical or chemical treatment of the product. In one thermal aging treatment, the precipitation hardenable plate alloy product is subjected to two or more main aging steps, although clear lines of demarcation may not exist between each step. It is generally known that ramping up to and/or down from a given or target treatment temperature can itself produce aging effects which can be, and often needs to be, taken into account by integrating such ramping conditions and their precipitation hardening effects along with the main aging steps of the total aging treatment. Such thermal integration is described in greater detail in U.S. Pat. No. 3,645,804 to Ponchel, which is incorporated by reference herein. With ramping and its corresponding integration, two or three steps for thermally treating the plate product according to the aging practice may be effected in a single, programmable furnace and meet the targeted properties for the product.

Aging practices are known to impact the mechanical and physical properties of the product such as strength, fracture toughness and corrosion resistance. Generally, overaged products (products heat treated beyond a peak maximum strength) exhibit improved corrosion resistance and improved fracture toughness at the expense of loss of strength. The strength requirements for the product may be balanced against the need for corrosion resistance of the alloy, particularly for 7xxx series alloys used in aerospace applications which are subjected to corrosive environments.

The aging integration method described in the '804 patent is relevant only to the overaged conditions of the aging process and does not account for the impact of aging prior to the overaged state. The portion of the aging process having overaged conditions is represented by the aging data points of FIG. 1 (a plot of tensile yield strength versus time) that are to the right of the peak strength.

The prior thermal integration method of the '804 patent accumulates the time-temperature effects and signals that the aging process is complete for a desired property in the alloy when the accumulated thermal effect reaches a value known to be associated with the desired property in a particular alloy. The integration formula can be expressed as $$K=\int\int dEdt$$

where K is a predetermined value for the alloy, E is a correction factor for each aging temperature and t is the period of time the alloy is at that temperature. The correction factor E can be expressed as $$E=\frac{t_T}{t_{T'}}$$

where $t_T$ is the time required to achieve a desired property (e.g., strength) at a target temperature T and $t_{T'}$ is the time required to achieve the same property at an arbitrary temperature T'. The E factor increases exponentially with temperature, yet the values of E are determined only for the overaged state of the alloy. No accounting is made for the thermal effects in the portion of the aging process where the alloy is in an underaged state, i.e. to the left side of the peak strength in FIG. 1.

According to the prior art method, aging at target temperatures is performed until the desired value of K is reached, with K having a predetermined correlation with strength. Strength per se is not calculated according to the prior art aging integration method, only the integrated value of K is calculated which is then correlated with strength. The starting point for that method is at the beginning of the overaging portion of an aging process, namely, at peak strength. The thermal effects of heating up an alloy and aging steps imposed before reaching peak strength are not considered. The K value is a measure of change in the thermal effect on the alloy (the time spent at each temperature) after peak strength is achieved and ranges from near zero (at peak strength) to a positive number (at reduced strength from overaging). The K value does not represent an actual property in the alloy.

In an effort to compare the thermal effect (K value) of the prior art method with actual strength, a value of strength for an overaged alloy correlated from calculations of K according to the prior art aging integration method was plotted over time in FIG. 1. The overaged portion of the curve exhibits some similarity to the actual strength of the alloy. According to such a correlation, in the underaged portion of the curve, the K value would be nearly zero and predicted strength would approach a maximum. See the prior art plot in FIG. 1. However, experience shows, as indicated by the data points of measured strength to the left of peak strength in FIG. 1, that yield strength begins low and increases during the underaged state of the alloy to a peak value and then decreases in the overaged portion of the aging process. The difference between the actual tensile yield strength (plotted data) and the tensile yield strength that would be determined based on the correlations used in the prior art model in the underaged portion of the graph represents an inaccuracy in the prior thermal integration method. Not only does the prior art method fail to predict an alloy property (e.g. strength), it does not account for the thermal effects of the entire aging process which includes the underaged portion.

Accordingly, a need remains for a method of integrating all of the thermal effects of artificial aging on properties of aluminum alloys that accounts for the entire artificial aging process (including the underaged portion) and allows for the calculation of properties of aged alloys.

SUMMARY OF THE INVENTION

This need is met by the present invention which includes a method of artificially aging an aluminum alloy product to achieve a property in the product for any arbitrary time-temperature profile. The method includes steps of providing an aluminum alloy product which may have been solution heat treated; aging the product with or without deformation to achieve the property by heating the product over an aging period, the aging period including a time period during which the product is in an underaged state; and terminating the aging step when the property is achieved according to a mathematical formula where the property is calculated as a function of time and product temperature measured over the aging period. The temperature of the product may be varied or may remain constant during a portion of the aging period. The aging period may further include additional time periods during which the product is in an overaged state.

Some suitable alloy properties for calculating according the present invention include strength (such as longitudinal tensile yield strength), corrosion resistance, hardness, fracture toughness and electrical conductivity. Strength is considered herein as one example of an alloy property and may be represented as a normalized (unitless) value of X as $$X(t,T)=X_s-\beta X_b$$

where β is a constant for the alloy, such that X is characterized by two mechanisms $X_s$ and $X_b$ having behaviors described by the following equations:

$$\frac{dY_s}{dt}n_sK_s^{1/n_s}Y_s^{1-1/n_s} \text{ where } Y_s=\ln\left(\frac{1}{1-X_s}\right);$$

$$\frac{dY_b}{dt}n_bK_b^{1/n_b}Y_b^{1-1/n_b} \text{ where } Y_b=\ln\left(\frac{1}{1-X_b}\right);$$

$$K_s=K_{s^\circ}\exp\left(-\frac{Q_s}{RT}\right);$$

$$K_b=K_{b^\circ}\exp\left(-\frac{Q_b}{RT}\right); \text{ and}$$

wherein $K_{s^\circ}$, $K_{b^\circ}$, $Q_s$, $Q_b$, $n_s$ and $n_b$ are experimentally determined constants for the alloy.

The aging step may be terminated when the desired value for X is attained and dX/dt is one of positive (alloy in the underaged state), zero (alloy at peak strength) or negative (alloy in the overaged state). Alternatively, the aging step may be terminated when dX/dt is positive, zero or negative and the desired value for σ is attained according to the following:

$$X(t,T)=\frac{\sigma-\sigma_w}{\sigma_p-\sigma_w}$$

where $\sigma_p$ is theoretical maximum strength for the alloy product; and $\sigma_w$ is the strength of the alloy product prior to the aging step.

The step of terminating aging may include cooling the product during a cooling time period wherein the property continues to change during the cooling time period so that the property is calculated as a function of time and alloy temperature measured over the aging period and the cooling time period.

The present invention further includes a system for artificially aging an aluminum alloy product to achieve a property in the alloy product. The system may have a heating apparatus for heating an alloy product during an aging period and an alloy temperature controller for controlling the temperature of the alloy product in the heating apparatus during the aging period. The controller includes software containing an algorithm for calculating a property of the alloy as a function of time and alloy product temperature measured over the aging period according to the above-described mathematical formulas.

DETAILED DESCRIPTION OF THE INVENTION

Figure 1:
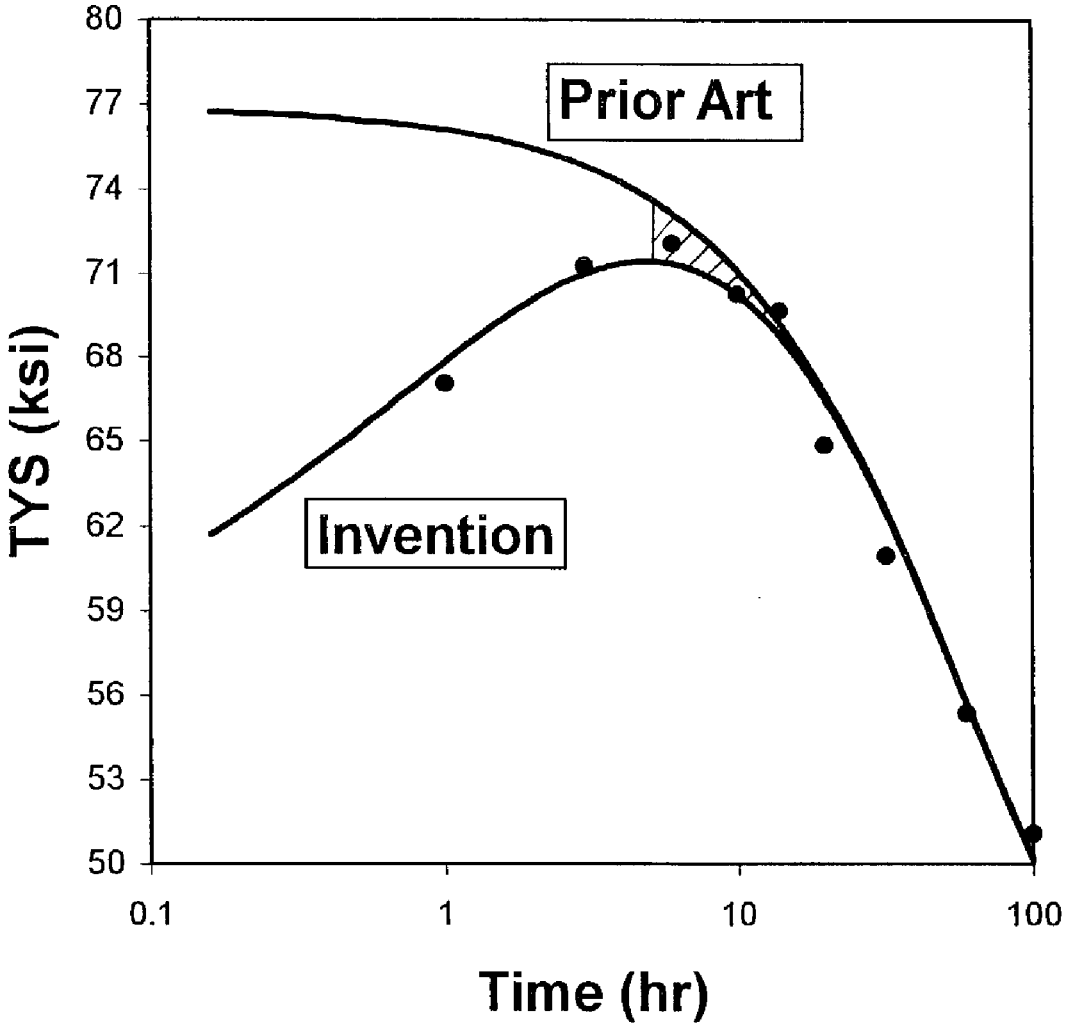
FIG. 1 is a graph of an aging curve with models thereof according to the prior art and the present invention.

The present invention is described with reference to the thermal exposure of aluminum alloy products in an artificial aging process generally employed to obtain high strength and high resistance to stress corrosion cracking. Heat treatable aluminum alloys are particularly suited for use with the present invention such as alloys of the AA series 2xxx, 6xxx and 7xxx, including AA 7085. Alloys suited for use with the present invention include alloys that are ready for aging, such as alloys that are solution heat treated, quenched, and residual stress relieved or that are rapidly cooled following hot working (e.g. rolling, extruding or forging) or the like. The aging process to which the present invention is applicable may be performed alone or in conjunction with other processes, such as mechanical treatments (e.g. age forming or machining) or chemical treatments (e.g. anodizing). The alloy may be in the form of a rolled product, an extrusion or a forging.

The temperature experienced by an aluminum alloy product during artificial aging may vary from a preselected temperature depending on the furnace employed, the position of the product within the furnace and the like. In addition, while an artificial aging process may call for a single step practice (constant temperature for a period of time) or a multiple step practice of heating the aluminum alloy product to one distinct temperature and holding the temperature constant for a period of time before changing to another temperature for another period of time, there can be a significant time period associated with heating up or cooling down to the specified temperatures. During that heat up or cool down time period, the product is exposed to thermal treatment, albeit of a varying temperature, which also may impact the properties of the alloy.

It is known that the precipitation hardening which occurs during aging involves different mechanisms of interaction of dislocations passing through the metal with respect to different sizes of the precipitates present. Dislocations tend to shear through small precipitates, while they loop around (bypass) large precipitates. The final properties of the alloy (e.g. strength) after aging are determined at least in part by these two mechanisms (shear and bypass) of interaction with moving dislocations. These competing mechanisms are accounted for in the mathematical model of the present invention.

In the present invention, the strength ($\sigma$) of an aluminum alloy product (e.g. longitudinal tensile yield strength) may be represented by a normalized strength X which varies as a function of time (t) and temperature (T) and where $$X(t, T) = \frac{\sigma - \sigma_w}{\sigma_p - \sigma_w} = X_s - \beta X_b$$

where $\beta$ is a constant for each alloy composition. The subscripts herein refer to the following aspects:

s=shear mode of interaction of precipitates b=bypass mode of interaction of precipitates p=theoretical peak w=W-temper $\infty$=theoretical minimum value at infinite aging The W-temper strength of the product to undergo artificial aging is $\sigma_w$ and is measured prior to artificial aging. The maximum attainable strength $\sigma_p$ is the theoretical peak strength for the alloy product, and the minimum strength $\sigma_\infty$ is achieved at theoretical infinite aging. These maximum and minimum strengths, $\sigma_p$ and $\sigma_\infty$, are constants determined for each particular alloy composition. The total normalized strength X theoretically ranges from 0 to 1 and includes two variables, $X_s$ (normalized strength from shear mode) and $X_b$ (normalized strength from bypass mode).

Figure 2:
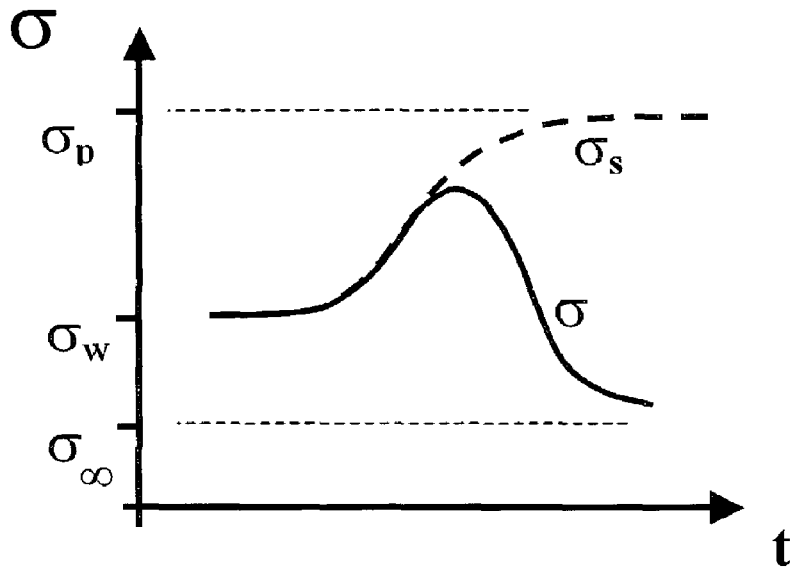
FIG. 2 is a graph of theoretical aging curves of strength versus time.
Figure 3:
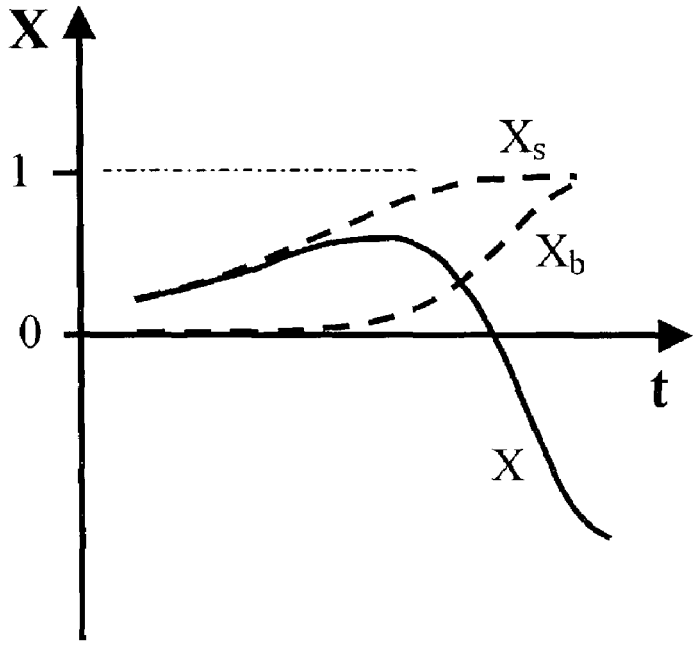
FIG. 3 is a graph of theoretical aging curves of normalized strength versus time.

The actual strength $\sigma$ begins at an initial value of $\sigma_w$. During aging, $\sigma$ typically reaches a maximum value that may approach $\sigma_p$ and then falls off during overaging. The relationship of $\sigma$ as a function of time (t) is shown in FIG. 2 for one aging practice. FIG. 3 shows the same data as in FIG. 2 transformed to the normalized strength X as a function of time (t).

The shear component of normalized strength, $X_s$, may be expressed as:

$$X_s = \frac{\sigma_s - \sigma_w}{\sigma_p - \sigma_w}$$

The bypass component of normalized strength, $X_b$ is as follows:

$$X_b = \frac{\sigma_s - \sigma}{\sigma_p - \sigma_\infty}$$

It should be appreciated by reference to FIG. 3 that for the overaged portion of the curve, $X_s$ approaches unity or $$X=1-\beta X_b.$$

When $X_s$ approaches unity, the relationship between tensile yield strength and time is as shown in FIG. 1 for the prior art correlated strength curve. Not only is the prior art correlated curve inaccurate for the underaged portion of the curve (to the left of peak strength), but in the beginning of the overaged portion of the curve (to the right of peak strength), there is a perceptible difference (shown by the hatched region in FIG. 1) between the strength calculated based on conventional practice of focusing only on the overaged state and the actual strength as well as the strength calculated according to the present invention. In contrast, the present invention accounts for the thermal effects prior to the overage conditions for the product by including both evolving variables $X_s$ and $X_b$.

The constant β may be calculated for a particular alloy composition according to the following equation:

$$\beta = \frac{\sigma_p - \sigma_\infty}{\sigma_p - \sigma_w}$$

It has been found that the aging process leading to the formation of precipitates in the alloy in both the underaged and overaged conditions is diffusion controlled and follows Avrami kinetics. This discovery allows $X_s$ and $X_b$ to be expressed mathematically as functions of time and temperature as follows:

$$\frac{dY_s}{dt} n_s K_s^{1/n_s} Y_s^{1-1/n_s} \text{ where } Y_s = \ln\left(\frac{1}{1-X_s}\right)$$

$$\frac{dY_b}{dt} n_b K_b^{1/n_b} Y_b^{1-1/n_b} \text{ where } Y_b = \ln\left(\frac{1}{1-X_b}\right)$$

The variables $K_s$ and $K_b$ are temperature (T) dependent as shown by the following:

$$K_s = K_{s^o} \exp\left(-\frac{Q_s}{RT}\right)$$

$$K_b = K_{b^o} \exp\left(-\frac{Q_b}{RT}\right)$$

where $K_{s^o}$, $K_{b^o}$, $Q_s$, $Q_b$, $n_s$ and $n_b$ are constants for each alloy composition.

Using these equations, a mathematical model is created based on time (t) and temperature (T) beginning with the startup of an aging process to solve for the normalized strength X and the corresponding strength σ.

In addition to β discussed above, for each particular alloy composition, the constants $K_{s^o}$, $K_{b^o}$, $Q_s$, $Q_b$, $n_s$ and $n_b$ are experimentally determined. Plots are made of strength σ (e.g., longitudinal tensile yield strength) versus time (t) for various temperatures (T). These data points of σ, t and T are used to generate a best fit curve for all temperatures, i.e., to determine the constants for an alloy composition which allow a best fit of the above-described equations to the data. The constants for that alloy composition are then adopted for subsequent control of artificial aging of the same alloy composition.

One feature of the present invention is the ability to determine the end point for an aging practice based on the calculated tensile yield strength. While conventional aging practice dictates stopping heat treatment only after following a predetermined procedure of heating to one or more temperatures for set time periods, the actual tensile yield strength (or other desired property) may not be the targeted value at the end point of the practice. Using the present invention, the temperature of the alloy product and the time spent at each temperature is input to a controller. The controller is equipped with a computer containing software having an algorithm for the alloy undergoing treatment written according to the above-described equations to calculate the tensile yield strength of the product while the heat treatment is ongoing. The software may be programmed to signal that the desired tensile yield strength has been achieved and may automatically institute the next aging step, shut down the furnace, apply cooling air to the products, provide notice to an operator to do so or the like. In this manner, unintended levels of overaged conditions and underaged conditions with the associated undesirable properties in the product may be avoided.

While industrial aging furnaces are designed to heat products uniformly, some temperature variation is known to exist between work pieces in a furnace or even within one work piece. Such temperature variance creates variability in the actual tensile yield strength. In the present invention, the temperature variance is used to calculate the resultant variance in tensile yield strength (σ). The calculated strength a may be used to select work pieces for subsequent use. Certain work pieces in a furnace may have calculated tensile yield strength directly on target and may be used for their intended purpose. Work pieces having calculated strengths outside the target may be identified as being of use in applications where strength is less critical or may even be scrapped. The additional information provided by the present invention allows for screening of work pieces based on their calculated properties.

The present invention may also be used to account for aging which occurs after the product is removed from the furnace. During the period of time that product cools and aging is decelerated, overaging continues with further decreases in tensile yield strength. By continuing to monitor the temperature of product after interruption of the aging process until the product has sufficiently cooled (and artificial aging virtually ceases), the present invention allows for calculation of the final tensile yield strength. Alternatively, once the degree of overaging and loss of tensile yield strength during cool down is known, subsequent aging processes may be operated to account therefor. The aging process may be interrupted before the target strength is achieved so that the added impact of aging during cool down results in the target strength.

Likewise, the thermal effects of the initial step of heating the product up to the desired aging temperature may be accounted for by including the time and temperature data for that portion of the aging process when performing the method of the present invention. The thermal effects of heat-up and cool down between aging steps in a multi-step aging practice may also be accounted for in a similar manner.

In use, the algorithm may be written to monitor for either σ or X and for a particular slope of the aging curve (e.g. strength vs. time). A typical aging curve as in FIG. 1 may pass through a strength value once while the slope of the curve is positive (for the underaging portion) and again while the slope of the curve is negative (during the overaging portion). Overaged product is generally desirable for a balance of corrosion resistance and strength; therefore, the endpoint of an aging process incorporating the present invention may be reached for a desired strength value at negative slope on the aging curve. In that case, the aging endpoint is reached when X (or σ) is a desired value and dX/dt is negative. The aging endpoint may also be set for conditions when dx/dt is positive or zero. Unlike in conventional aging practice which accounts only for the overaged condition, the present invention is useful for determining the properties of alloys over the entire aging process including both the underaged condition and the peak aged condition.

The W-temper of product may be considered to be a starting point for the artificial aging process. In conventional industrial practice, the tensile yield strength at W-temper ($\sigma_w$) of the product is measured shortly after quenching and any stretching or compressing steps. However, the product continues to age naturally prior to the onset of the artificial aging process. It has been found that changes in $\sigma_w$ (e.g., of about 7 ksi) do not impact the accuracy of the calculated overage strength $\sigma$. For those situations, although $\sigma_w$ has changed slightly, the change to the constant $\beta$ is minimal and may not warrant refitting the plotted isothermal curves to determine new constants for the alloy composition.

Modifications, intentional or otherwise, to an alloy composition may cause its actual strength to be different from the calculated strength $\sigma$. The mathematical model of the present invention may be refitted for the new composition by altering $\sigma_p$ without changing the remaining constants. Hence, it should be appreciated that the present invention is robust for many aluminum alloy production practices.

The present invention is described in reference to modeling and control of the thermal effects of artificial aging on tensile yield strength. However, this is not meant to be limiting. Other properties of an aged aluminum alloy (such as corrosion resistance, hardness, fracture toughness and electrical conductivity) may be controlled according to the present invention wherein the property is calculated according to a mathematical formula as a function of time and alloy temperature over the aging period which includes a time period in which the alloy is underaged or has not reached a desired property. Other multiple mechanism formulas similar to those described herein with reference to strength may be applicable to these other properties. Such other multiple mechanism formulas may or may not be mathematically similar to the formulas described herein for strength.

Although the invention has been described generally above, the particular examples give additional illustration of the product and process steps typical of the present invention.

EXAMPLE 1

Determine Constants

Figure 4:
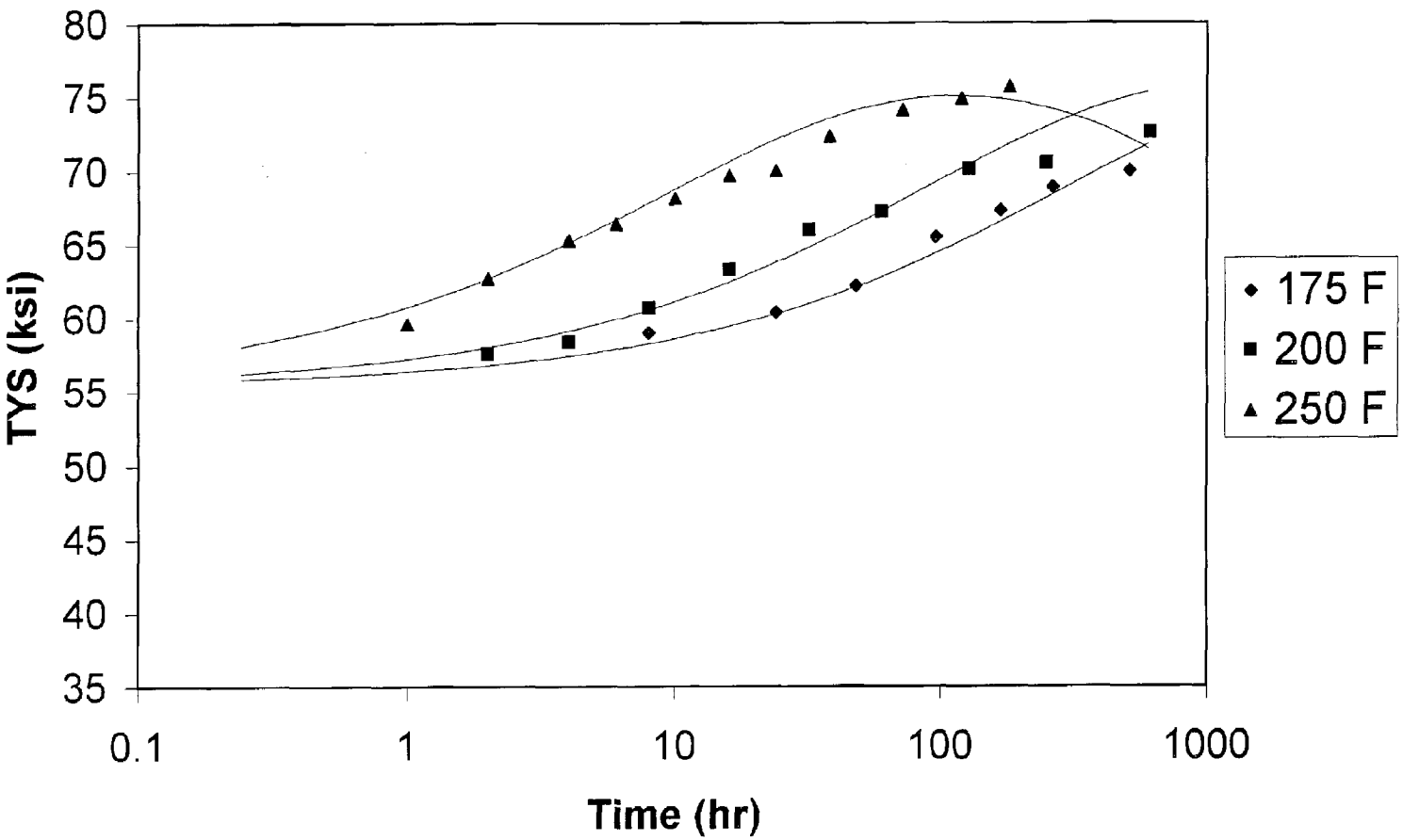
FIG. 4 is a graph of isothermal aging of an AA 7085 series alloy at temperatures of 175–250° F. and best fit curves by the model of the present invention.

Six-inch thick plates of W-temper AA 7085 were fabricated in an industrial plant. The plates were rapidly heated to an isothermal soak at temperatures ranging between 175° F. and 330° F. in a laboratory scale furnace. The longitudinal tensile yield strength of the plates was measured over time during the aging processes. FIG. 4 includes plots of aging data (strength vs. time) at 175°, 200° and 250° F., and FIG. 5 includes aging data at 275°, 300°, 310°, 320° and 330° F. The data for each temperature was fitted to the equations described above to determine the constants as listed in Table 1:

TABLE 1

| Constant | Value | Constant | Value |
|---|---|---|---|
| $\sigma_w$ | 55.4 ksi | $K_{b°}$ | $9.832 \times 10^{14}$/sec |
| $\sigma_p$ | 76.9 ksi | $Q_s$ | 49,982 J/gmole K |
| $\sigma_\infty$ | 43.7 ksi | $Q_b$ | 163,450 J/gmole K |
| $\beta$ | 1.546 | $n_s$ | 0.532 |
| $K_{s°}$ | $1.56 \times 10^3$/sec | $n_b$ | 0.933 |

Figure 5:
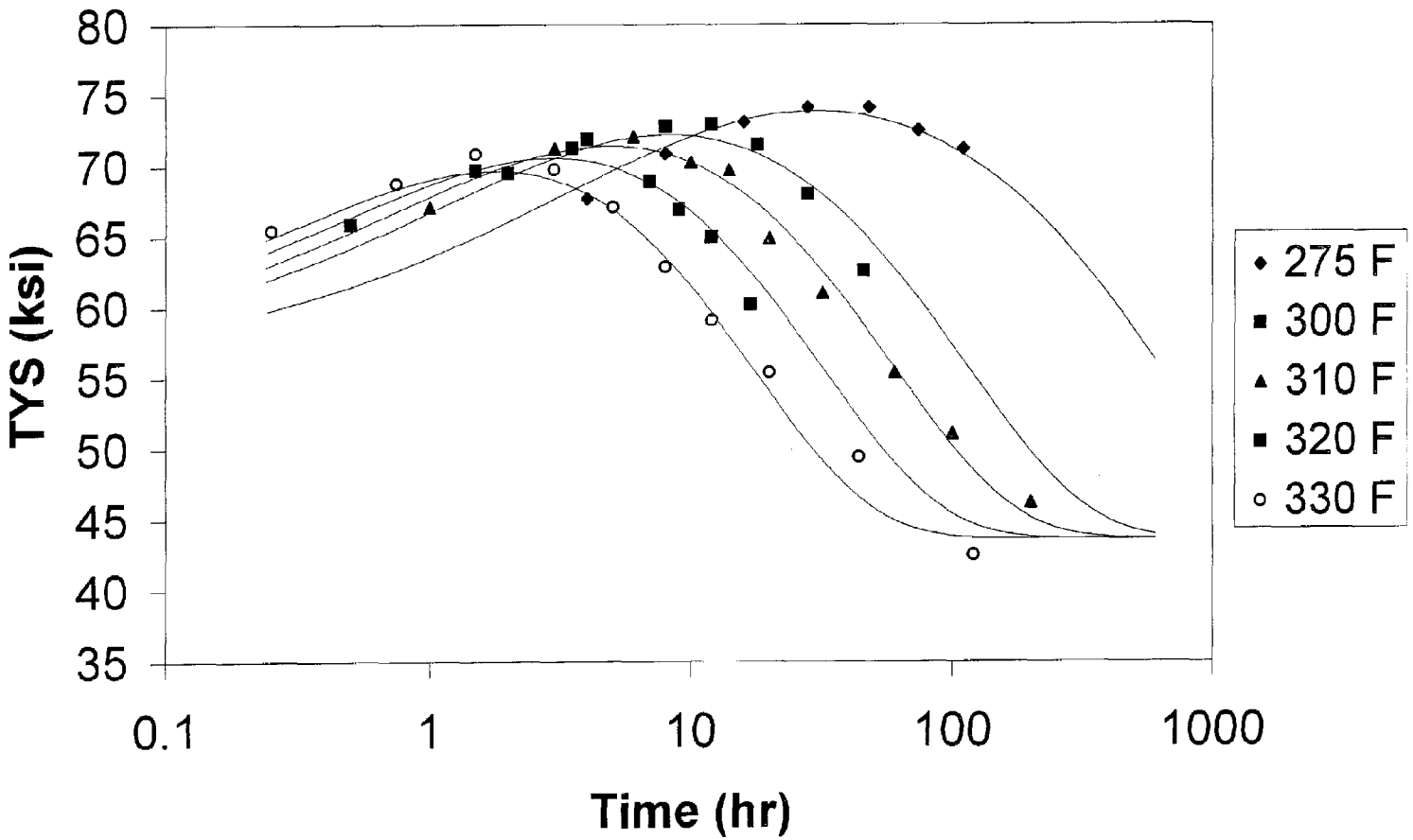
FIG. 5 is a graph of isothermal aging of the AA 7085 series alloy at temperatures of 275–330° F. and best fit curves by the model of the present invention.

The curves shown in FIGS. 4 and 5 are the best fits for the data therein using these experimentally determined constants.

EXAMPLE 2

Model

Figure 6:
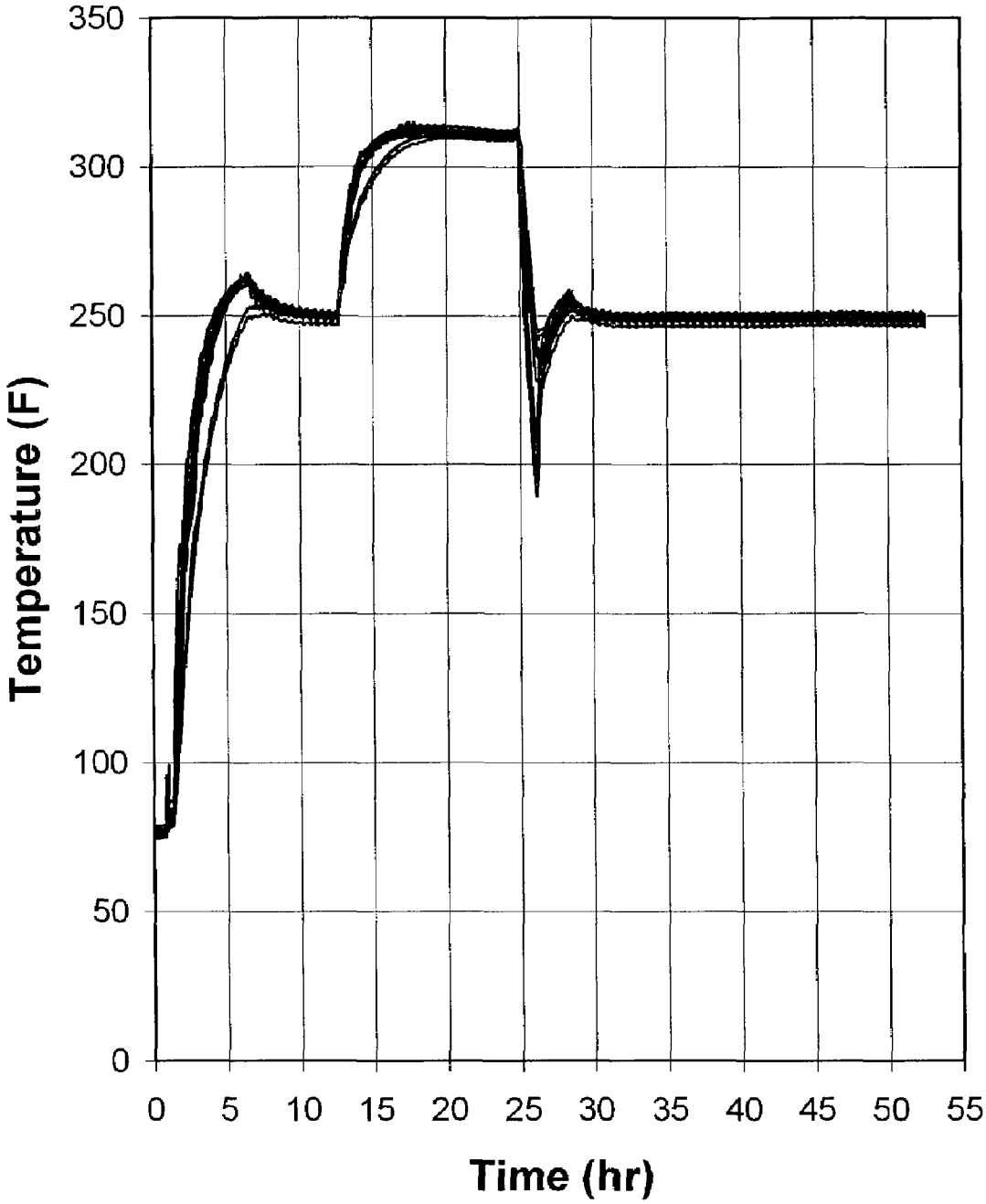
FIG. 6 is a graph of temperature versus time for an artificially aged AA 7085 series alloy.
Figure 7:
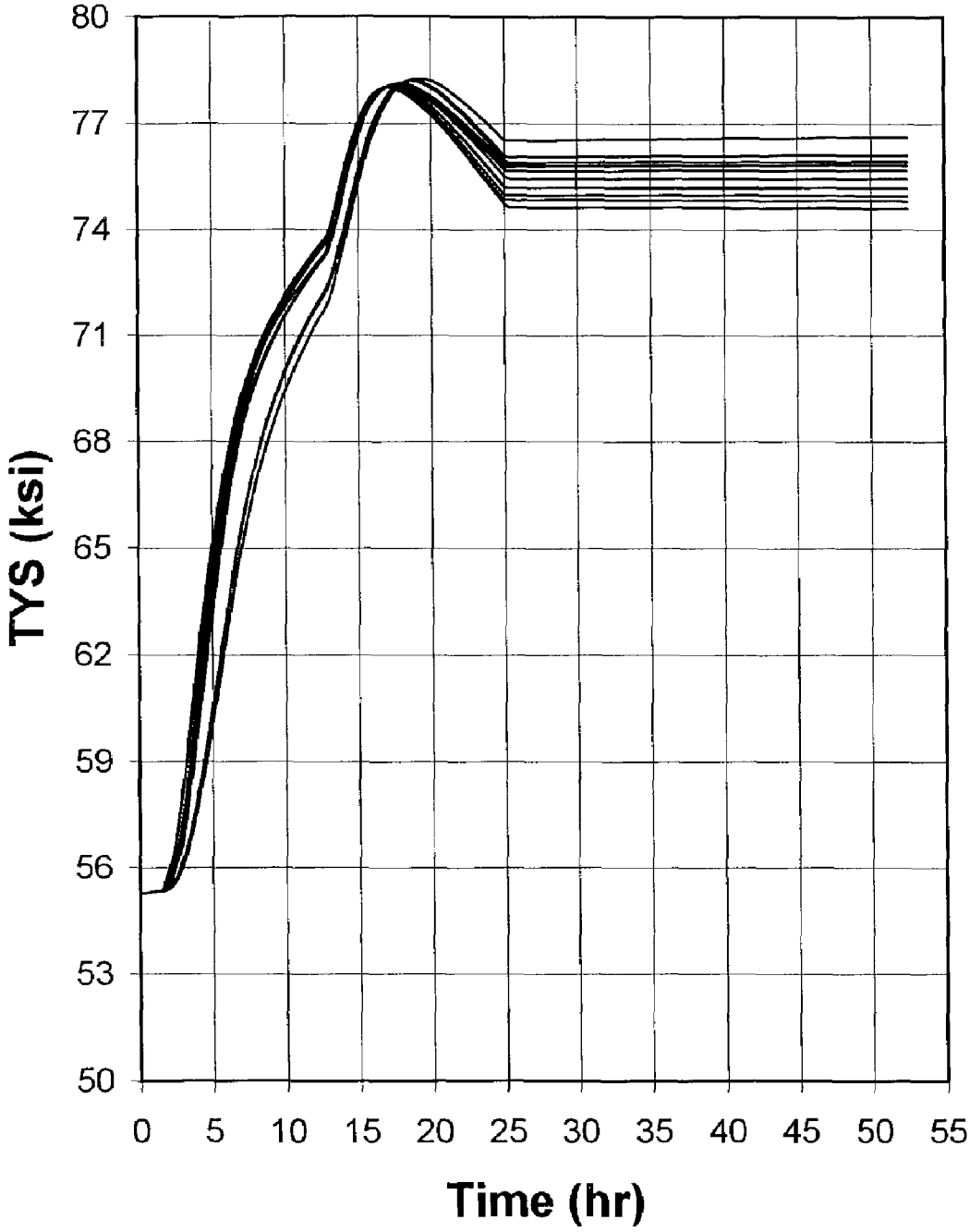
FIG. 7 is graph of calculated tensile yield strength versus time for the same alloy.

Six-inch thick plates of W-temper AA 7085 were artificially aged according to a conventional aging practice in an industrial furnace. In a two-step process, the plates were brought to about 250° F. in about 7 hours and held for about 6 hours and subsequently heated to about 310° F. and held for 10 hours and then cooled to about 250° F. and held for about 24 hours. Twelve thermocouples measured the temperature of the plates at various locations in the furnace. The resulting time and temperature profile for each of the twelve thermocouples is shown in FIG. 6 which demonstrates the variability in actual temperature experienced by the plates. The actual tensile yield strength was determined experimentally to be 75.6 ksi. Using the mathematical model of the present invention, the tensile yield strength $\sigma$ for the plates was calculated and is shown over time in FIG. 7. When the curves for FIG. 1 were initially produced, there was an offset of the calculated final strengths from the actual strength. The offset is believed to be due to an artifact in using the constants listed above from the laboratory scale aging experiment of Example 1 in the industrial scale aging process of this Example 2. A value of 84.0 ksi for $\sigma_p$ used to produce the curves in FIG. 7 so that the final calculated tensile yield strengths were consistent with the measured strength of 75.6. The variation between 75 and 76 ksi of the calculated strengths is indicative of the variation of actual temperatures of the plates as measured by the thermocouples.

The desired final strength of about 76 ksi occurred first at about 15 hours and again at 25 hours. All the desired properties may not be achieved prior to passing through a point of maximum strength; hence the present invention permits selection of the proper time at which the desired strength and other properties are achieved.

Figure 8:
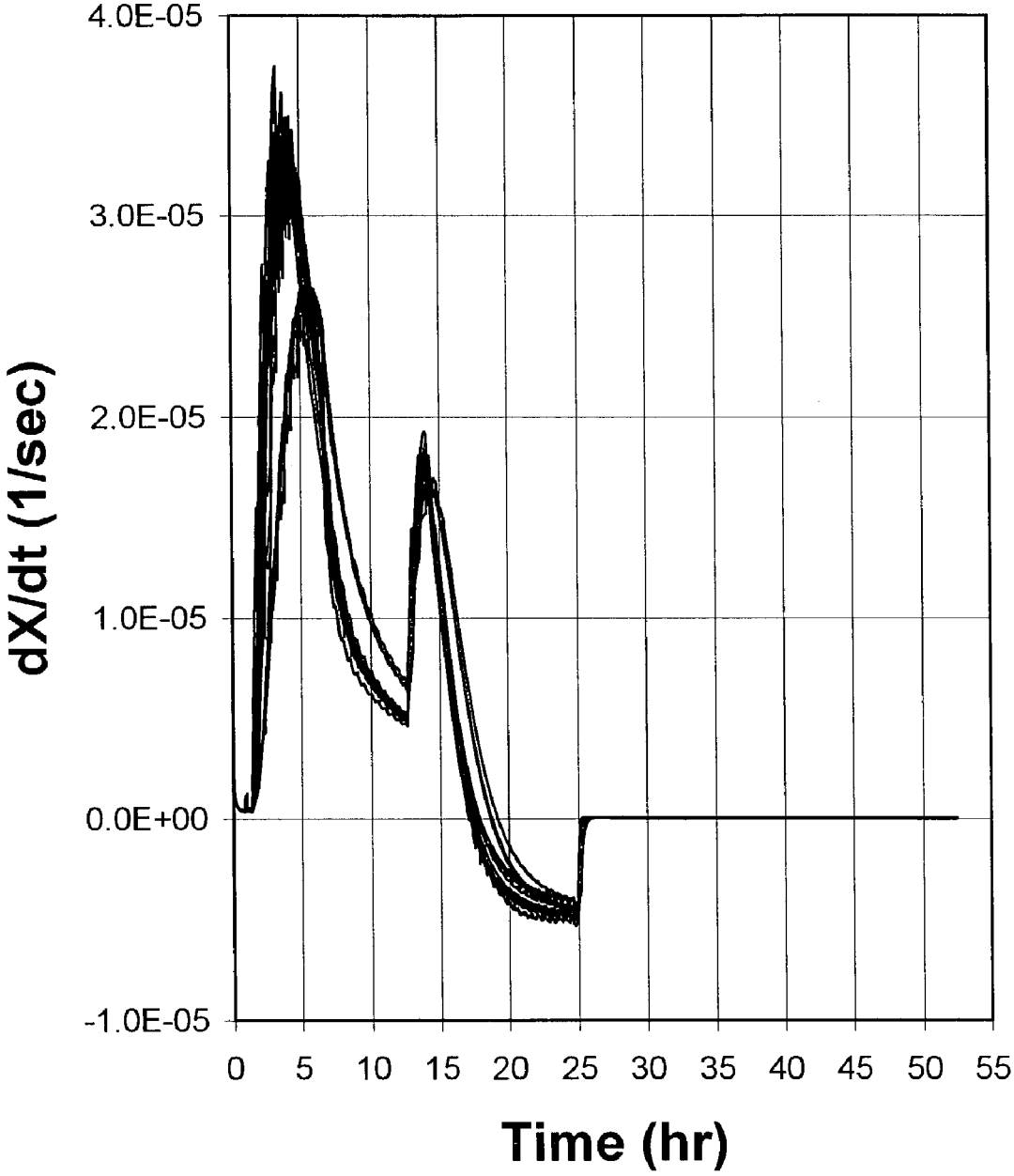
FIG. 8 is a graph of rate of change in calculated strength versus time for the same alloy.

The rate of change of calculated normalized strength X or dX/dt is shown in FIG. 8. The rate of strength change initially increased during the first period of heat-up, decreased between about 5 and 12 hours during the first isothermal treatment stage at about 250° F., increased again during the second heat-up period and finally decreased to below zero between about 14 and 25 hours during the second treatment stage at about 310° F. Negative rate of strength change began at about 17 hours when maximum strength was achieved as evidenced by the peak strength of about 78 ksi shown in FIG. 7. Although this aging process was controlled according to conventional aging practice based on a pattern of predetermined time at temperature, these data demonstrate that the next stage in the aging process could have been instituted based on the calculated strength of about 76 ksi and negative dX/dt, namely at about 23 hours.

Having described the presently preferred embodiments, it is to be understood that the invention may be otherwise embodied within the scope of the appended claims.

We claim:

1. A method of artificially aging an aluminum alloy product to achieve a property in the product wherein the value of the property varies in response to aging, the method comprising:

heating an aluminum alloy product over an aging period which includes a time period during which the product is in an underaged state and terminating the aging period when the property is achieved according to a mathematical formula evaluated for each temperature regime experienced by said product, wherein said mathematical formula is a time- and temperature-dependent expression of the property comprising at least two time-domain and temperature-domain evolving variables, and wherein the product is optionally age formed and, wherein the property is tensile yield strength and said time and temperature-domain evolving variables are $X_s$ and $X_b$ and wherein said time- and temperature-dependent expression of the property comprises $$X(t,T)=X_s-\beta X_b$$

wherein X is a normalized value of strength and β is a constant for the alloy and X is solved from the following equations:

$$\frac{dY_s}{dt}n_sK_s^{1/n_s}Y_s^{1-1/n_s} \text{ where } Y_s=\ln\left(\frac{1}{1-X_s}\right);$$

$$\frac{dY_b}{dt}n_bK_b^{1/n_b}Y_b^{1-1/n_b} \text{ where } Y_b=\ln\left(\frac{1}{1-X_b}\right);$$

$$K_s=K_{s^o}\exp\left(-\frac{Q_s}{RT}\right);$$

$$K_b=K_{b^o}\exp\left(-\frac{Q_b}{RT}\right); \text{ and}$$

wherein $K_{x''}$, $K_{b''}$, $Q_s$, $Q_b$, $n_s$ and $n_s$ are constants for the alloy.

2. The method of claim 1 wherein the aging step is terminated when the desired value for X is attained and the value of dX/dt is selected to be about zero or negative.

3. The method of claim 1 wherein said aging step is terminated when dX/dt is negative and the desired value for σ is attained according to the following:

$$X(t,T)=\frac{\sigma-\sigma_w}{\sigma_p-\sigma_w}$$

where $\sigma_p$ is a theoretical maximum strength for the product; and $\sigma_w$ is the strength of the product prior to said aging step.

* * * * *

UNITED STATES PATENT AND TRADEMARK OFFICE

CERTIFICATE OF CORRECTION

PATENT NO. : 7,018,489 B2
APPLICATION NO. : 10/294093
DATED : March 28, 2006
INVENTOR(S) : William D. Bennon, Vivek M. Sample and Dhruba J. Chakrabarti It is certified that error appears in the above-identified patent and that said Letters Patent is hereby corrected as shown below:

In column 12, line 13, after "wherein", delete "$K_{x''}$, $K_{b''}$, $Q_s$, $Q_b$, $n_s$ and $n_s$"

and insert -- $K_{s°}$, $K_{b°}$, $Q_s$, $Q_b$, $n_s$ and $n_b$ --.

Signed and Sealed this

Eleventh Day of August, 2009

David J. Kappos

David J. Kappos
*Director of the United States Patent and Trademark Office*